United States Patent [19]

Kefer et al.

[11] Patent Number: 4,700,645

[45] Date of Patent: Oct. 20, 1987

[54] SEWING MACHINE HOUSING CONSTRUCTION

[75] Inventors: Joseph Kefer, Bruchsal; Gerhard Ruf, Karlsruhe, both of Fed. Rep. of Germany

[73] Assignee: Dorina Nähmaschinen GmbH, Fed. Rep. of Germany

[21] Appl. No.: 907,742

[22] Filed: Sep. 15, 1986

[30] Foreign Application Priority Data

Sep. 18, 1985 [DE] Fed. Rep. of Germany ..... 3533205

[51] Int. Cl.[4] ..... D05B 73/00

[52] U.S. Cl. ..... 112/259; D15/69

[58] Field of Search ..... 112/258, 259; 382/59; 250/353; D15/69; 43/42.24

[56] References Cited

U.S. PATENT DOCUMENTS

| | | | |
|---|---|---|---|
| 4,193,361 | 3/1980 | Johnson | 112/259 |
| 4,421,042 | 12/1983 | Killinger | 112/259 |
| 4,486,661 | 12/1984 | Guscott et al. | 250/353 |
| 4,552,081 | 11/1985 | Vartoukian et al. | 112/258 |
| 4,573,283 | 3/1986 | Pippert | 43/42.24 X |
| 4,593,186 | 6/1986 | Swartz et al. | 382/59 |
| 4,628,845 | 12/1986 | Matsuda | 112/259 |

FOREIGN PATENT DOCUMENTS

| | | | |
|---|---|---|---|
| 2312587 | 5/1973 | France | 112/259 |

*Primary Examiner*—Werner H. Schroeder
*Assistant Examiner*—Andrew M. Falik
*Attorney, Agent, or Firm*—McGlew and Tuttle

[57] ABSTRACT

A sewing machine housing includes a base to hold the machine's drive mechanism and a covering mounted on the base. To effect an easy alteration of the outer shape, the covering comprises a plurality of individual covering pieces with edge contours aligned with one another, the individual covering pieces being detachably connected to the base or to one another. In order to adapt to differently designed operating means in a given area of the base to be covered, a plurality of individual covering pieces are provided for that area with a plurality of different shapes with essentially the same edge contours and edge design.

5 Claims, 4 Drawing Figures

SEWING MACHINE HOUSING CONSTRUCTION

FIELD AND BACKGROUND OF THE INVENTION

This invention relates in general to sewing machines and in particular to a new and useful sewing machine housing which is made up of a plurality of interfitting parts.

In a similar prior art sewing machine (German Pat. No. 901 864), the base that holds the sewing machine drive mechanism is partly enclosed by detachable cover plates in order to enable the base to be designed as a simple shape producible by die-casting. This arrangement does not provide for any alteration in the shape of the housing.

SUMMARY OF THE INVENTION

The invention provides a sewing machine whose outer shape can be changed easily in a variety of ways.

The features of the invention not only offer the possibility of adapting the outer contours of the sewing machine to the formation of differing actuating means that project beyond the sewing machine, but also make it possible for the first time to give the outer housing of the sewing machine a completely different look merely by replacing a single piece of the covering, whether the machine's drive mechanism is the same or different. In this manner a large number of substantially differing shapes can be obtained for the outer housing.

Other advantageous developments of the invention provides, e.g. for the possibility of a number of different shape designs for the sewing machine. In addition, it also offers the possibility of adapting the outer housing of the sewing machine to varying designs of the operating elements seated in the housing base and projecting beyond the outer housing.

The design of the mutual connection of a part of the individual covering pieces enables the covering pieces to be mounted on the base without visible connecting means.

Accordingly, it is an object of the invention to provide an improved sewing machine housing which includes a base portion for holding a machine drive mechanism and a covering mounted on the base which comprises a plurality of individual covering pieces detachably joined to the base or to one another.

A further object of the invention is to provide a sewing machine which includes a plurality of interfitting parts which may be assembled and interconnected in a variety of ways and which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
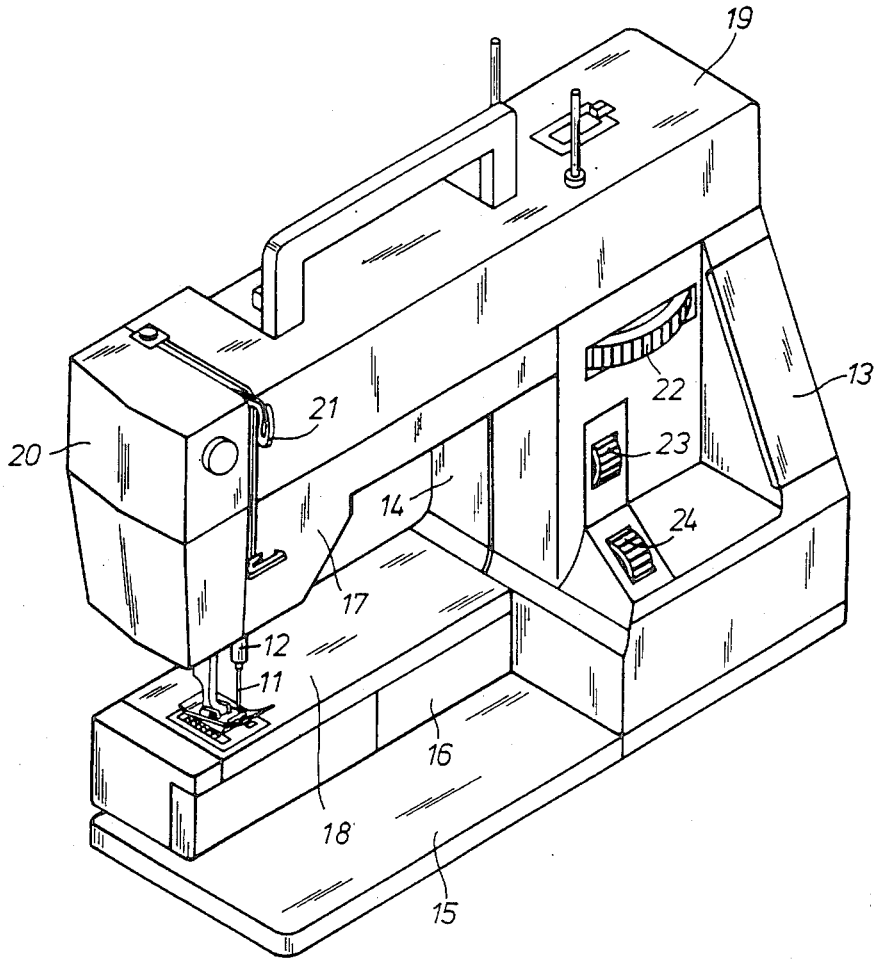
FIG. 1 is a perspective view of a domestic sewing machine constructed in accordance with the invention.

Referring to the drawings in particular the invention embodied therein comprises sewing machine which comprises a base which holds a machine drive mechanism and has a covering mounted on the base constructed so that a plurality of individual covering pieces may be detachably joined to the base and/or to one another.

Figure 2:
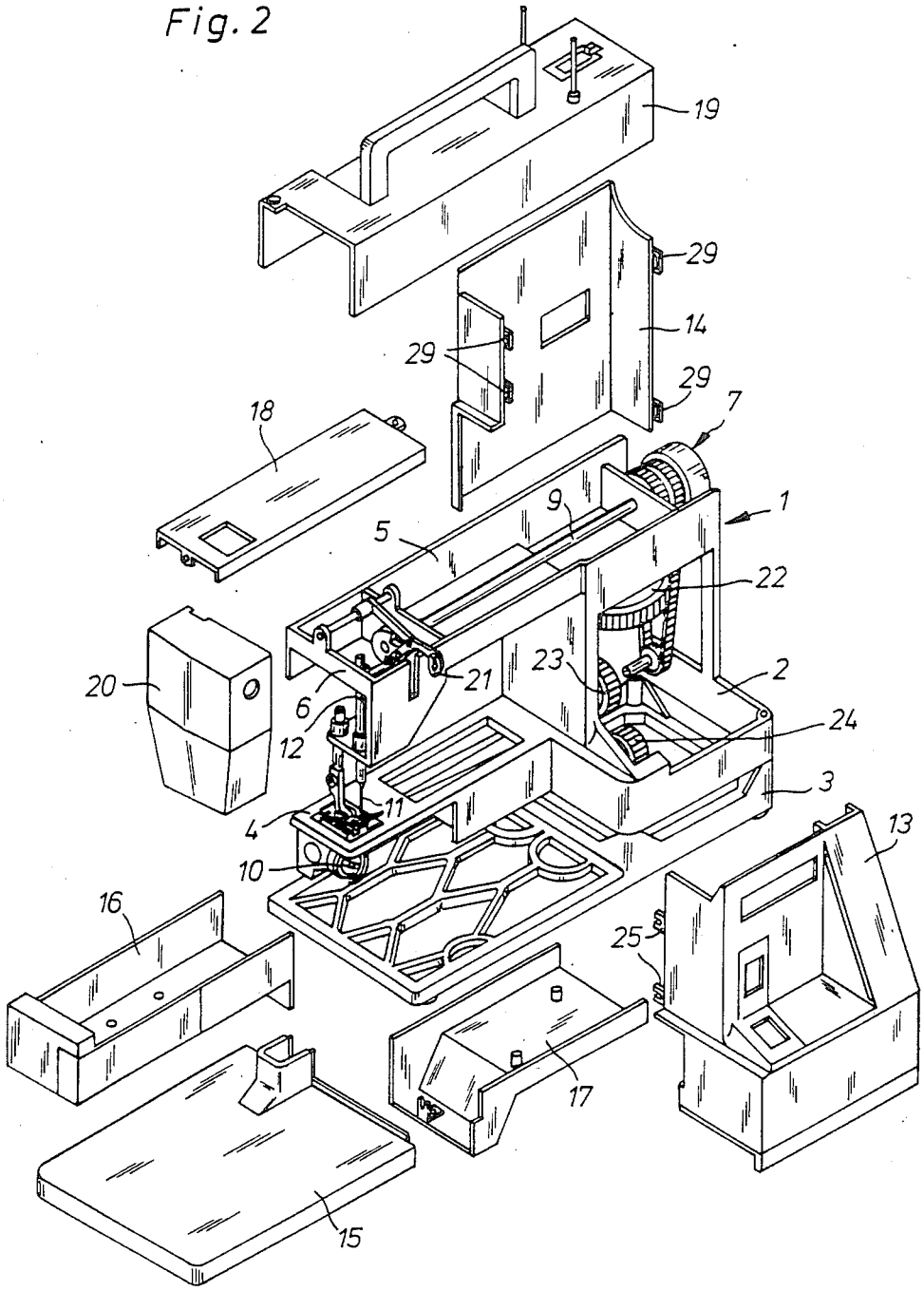
FIG. 2 is an exploded perspective view of the sewing machine shown disassembled.

The sewing machine shown in assembled condition in FIG. 1 has, as shown in FIG. 2, a base 1 comprising a standard 2, a base plate 3, a lower arm 4 and an upper arm 5 ending in a head 6. In the base 1 the drive mechanism 7 of the sewing machine is mounted conventionally, and it is driven by a sewing machine motor also mounted in the base 1 via a main shaft 9 seated in the upper arm 5. The seat 5 also drives a shuttle 10 in the lower arm 4 and a needle bar 12, bearing a needle 11, that is mounted in the head 6.

The base 1 has rather large openings for unhampered access to the sewing machine drive mechanism 7. In order to cover the base 1, individual covering pieces 13 through 20, made of shock-resistant plastic, are provided. They create the outer shape of the housing and give the sewing machine its appearance. The outer surface they constitute is interrupted only by openings for operating or functioning parts that project outside it, such as the thread take-up lever 12, needle bar 12, adjustment controls 22, 23, 24, etc.

The edge contours of two adjacent individual covering pieces 13 through 20 are so aligned with one another wherein they meet that they can be fitted together into a continuous surface broken only by a line of separation.

Figure 4:
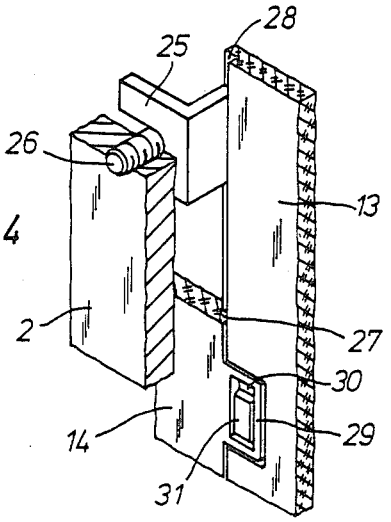
FIG. 4 is an enlarged elevation and sectional perspective view of the connection between the edges of two individual covering pieces.

Individual covering piece 13 is mounted on the front of the standard 2 by brackets 25 bent laterally at right angles (FIG. 4), which are firmly attached to the standard 2 by screws 26. Covering piece 14 slides onto the back of the standard 2. The mutual edge contours of the two covering pieces 13 and 14 are designed as an overlapping joint with set-back edge zones 27 and 28, which fit together to form a smooth joint from the outside. Covering piece 14 also has tabs 29, each with a hole 30 When covering pieces 13 and 14 are fitted together, corresponding snap pieces 21 on covering piece 13 go into the holes 30, so that a snap lock arrangement secures the covering piece 14 in place.

The remaining individual covering pieces 15 through 20 are each mounted on the base 1 by means of screws, not shown.

Figure 3:
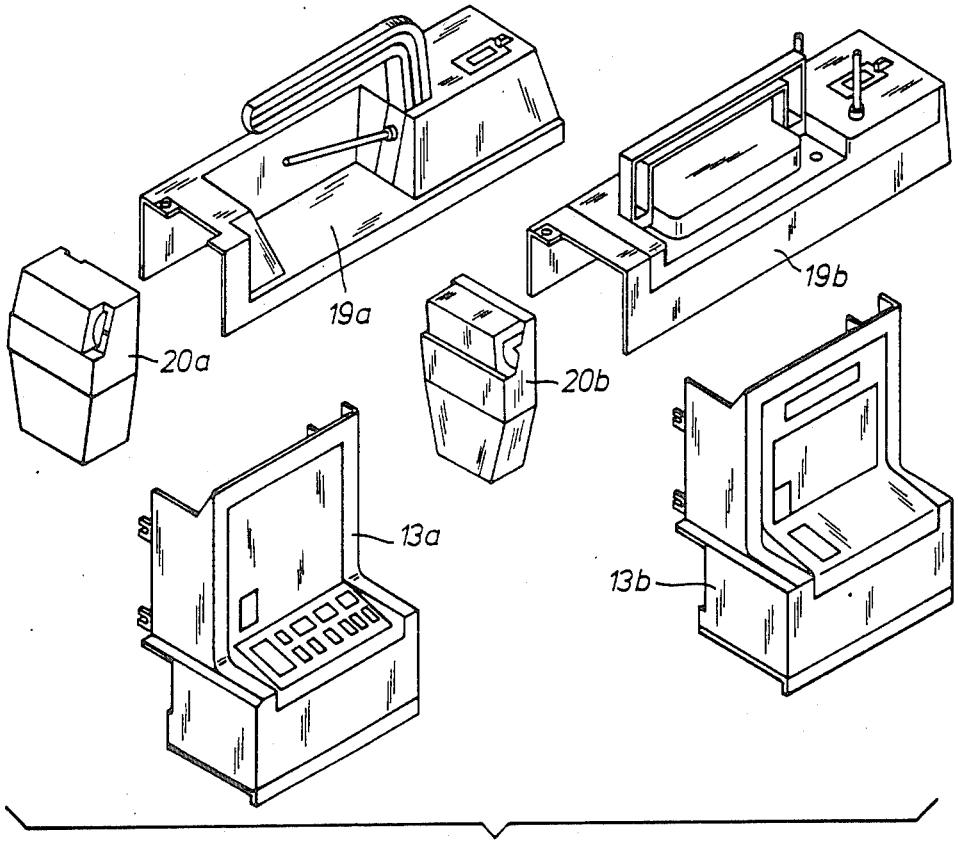
FIG. 3 is a perspective view of different alternative parts for the individual covering pieces.

By replacing the individual covering pieces 13, 19 and 20 depicted in FIG. 2 with the individual covering pieces 13*a*, 19*a* and 20*a* or 13*b*, 19*b* and 20*b* shown in FIG. 3, the shape of the sewing machine can be altered. Thus, the outer housing of the sewing machine can be adapted easily to different or additional technical functioning or operating elements by switching one or just a few individual covering pieces.

While specific embodiments of the invention have been shown and described in detail to illustrate the application of the principles of the invention, it will be understood that the invention may be embodied otherwise without departing from such principles.

What is claimed is:

1. A sewing machine, comprising a base for holding a machine drive mechanism, a housing base covering extending over said base, a plurality of individual covering pieces attachably joinable to said housing base covering and to each other by an edge connection, at least some of said plurality of individual covering pieces being of different shapes and having substantially the same edge contours and edge designs so that they are interchangeable with one another at a specific location on said housing base covering whereby the shape of the sewing machine can be changed.

2. A sewing machine according to claim 1, wherein the edge connection of any adjoining individual covering pieces is designed as an overlap connection with a snap lock.

3. A sewing machine according to claim 1, wherein the individual covering pieces are made of shock resistant plastic.

4. A sewing machine comprising a machine drive mechanism including an upper drive portion for driving a sewing needle and a lower drive portion for driving a bobbin, a housing cover including a widened base portion and a lower arm portion extending outwardly therefrom covering a drive portion for said bobbin and providing a support for material to be fed, an upright portion encompassing part of the drive mechanism and a horizontally extending head portion covering the upper drive portion for the needle and a head at the end of said upper horizontal head portion, said housing cover having open portions in the front thereof along said upper arm portion and said lower arm portion and including a front piece engageable on the open front portion and closing it, an upper arm cover portion engageable over the upper arm cover and closing it and a portion covering the head of said machine and closing it.

5. A sewing machine according to claim 4, including a plurality of cover pieces which are snap-fitted with said cover.

* * * * *